US005310126A

United States Patent [19]

Hensen et al.

[11] Patent Number: 5,310,126

[45] Date of Patent: May 10, 1994

[54] APPARATUS FOR LOOSENING A RESERVE YARN WINDING FROM THE PERIPHERY OF A COP

[75] Inventors: Helmuth Hensen; Hans Grecksch, both of Mönchengladbach; Hermann-Josef Meul, Hückelhoven; Karl-Heinz Floh, Mönchengladbach, all of Fed. Rep. of Germany

[73] Assignee: W. Schlafhorst AG & Co., Moenchengladbach, Fed. Rep. of Germany

[21] Appl. No.: 948,024

[22] Filed: Sep. 21, 1992

[30] Foreign Application Priority Data

Sep. 21, 1991 [DE] Fed. Rep. of Germany ..... 4131454
Feb. 11, 1992 [DE] Fed. Rep. of Germany ..... 4203934

[51] Int. Cl.[5] ..... B65H 67/08
[52] U.S. Cl. ..... 242/35.6 OE
[58] Field of Search ..... 242/35.6 E, 35.6 R, 242/18 R, 35.5 A, 35.5 R, 19

[56] References Cited

U.S. PATENT DOCUMENTS

| | | | |
|---|---|---|---|
| 2,675,971 | 4/1954 | Abbott | 242/35.6 R |
| 3,059,866 | 10/1962 | Reiners | 242/35.6 E |
| 3,224,694 | 12/1965 | Oishi | 242/35.5 A X |
| 3,381,908 | 5/1968 | Igushi et al. | 242/35.6 E |
| 4,169,563 | 10/1979 | Leu | 242/35.6 E |
| 4,267,983 | 5/1981 | Leu | 242/35.6 E |
| 4,276,742 | 7/1981 | Raasch et al. | 242/35.6 R X |
| 4,896,841 | 1/1990 | Topuett | 242/35.6 E |
| 5,083,715 | 1/1992 | Wirtz et al. | 242/18 R |
| 5,104,052 | 4/1992 | Wey et al. | 242/18 R |

FOREIGN PATENT DOCUMENTS

| | | | |
|---|---|---|---|
| 6502 | 2/1974 | Japan | 242/35.6 E |

*Primary Examiner*—Stanley N. Gilreath
*Attorney, Agent, or Firm*—Herbert L. Lerner; Laurence A. Greenberg

[57] ABSTRACT

A winding machine has winding stations and a transport path for leading cops to the winding stations. An apparatus for loosening a reserve yarn winding from peripheries of the cops disposed at the transport path includes scissors having two legs being open at an onset of a yarn search. One of the legs is a yarn loosener to be placed against a cop positioned on the transport path. The cop is rotated to bring the yarn loosener under the reserve yarn winding. An actuator closes the scissors after a predetermined search period. The apparatus for loosening the reserve yarn winding may include a yarn loosener to be placed at a cop positioned on the transport path, wherein the yarn loosener has a forward edge for picking up a yarn, and a sharp cutting edge with a height being increased at increasing distances from the forward edge for cutting the yarn.

13 Claims, 7 Drawing Sheets

APPARATUS FOR LOOSENING A RESERVE YARN WINDING FROM THE PERIPHERY OF A COP

The invention relates to an apparatus for loosening a reserve yarn winding from peripheries of cops disposed at a transport path leading to winding stations of a winding machine, with a yarn loosener which may be placed against a cop positioned on the transport path, and means for rotating the cop to bring the yarn loosener under the reserve yarn winding.

At the completion of cop production in ring spinning machines, for example, it is conventional to form a reserve yarn winding with the yarn end running from the nose of the cop in a direction toward the foot of the cop. A ring rail is thereby moved relatively quickly from top to bottom with already decelerating spindles. The reserve yarn winding may end at the tube foot in an underwinding or reserve yarn coil. The reserve yarn winding may lie relatively tightly on the periphery of the cop.

In preparing such cops for the unwinding operation in a winding machine, it is important that the yarn end be exposed if at all possible without damaging the surface of the yarn package, in such a way that it may be retrieved in the unwinding position and presented to the respective units of the winding station.

Devices for locating the yarn end on the periphery of cops and then presenting it in a defined position for the unwinding process, are already known. In most of those devices, the cops are, for instance, driven in a circular path at several different processing stations, which results in a gradual preparation process.

U.S. Pat. No. 2,675,971 also describes a preparation apparatus for cops which are supplied to the winding stations of a winding machine. Prior to locating the yarn end, the reserve yarn winding is thereby loosened by means of a hook which is formed of bent wire from a suction slot disposed along a suction tube. That hook is supported in an articulation point and, among other things, it is displaced parallel to the longitudinal axis of the cop due to the yarn pull of the engaged yarn, which is to prevent the hook from catching in the yarn layers. The hook is thereby engaged in the surface of the cop until the cop has moved along the transport path by a certain distance. When the hook grabs the reserve yarn winding yarn immediately after coming into contact with the cop surface, it will pull the yarn section which runs toward the nose of the cop tightly onto the surface of the cop winding. Due to the downward movement of the hook, there is a danger that the yarn will tear relatively late, which leads to a situation wherein additional, relatively flat and very tight windings are placed on the cop surface. Any retrieval with following devices is thus substantially impaired.

A device for loosening the reserve yarn winding which is known from German Published, Non-Prosecuted Application DE 39 25 988 A1, corresponding to U.S. Pat. No. 5,083,715, differs from the prior devices especially due to the fact that a control for catching the reserve yarn winding with the yarn loosener is provided.

What all of the devices have in common is that they are unsuitable for loosening relatively tight yarns, in particular when they run into the above-described underwinding at the tube foot.

This can lead to a blocking of the entire transport system.

It is accordingly an object of the invention to provide an apparatus for loosening a reserve yarn winding from the periphery of a cop, which overcomes the hereinafore-mentioned disadvantages of the heretofore-known devices of this general type and which possesses a high degree of effectiveness, independently of the tightness of the yarns to be loosened.

With the foregoing and other objects in view there is provided, in accordance with the invention, in a winding machine having winding stations and a transport path for leading cops to the winding stations, an apparatus for loosening a reserve yarn winding from peripheries of the cops disposed at the transport path, comprising scissors having two legs being open at an onset of a yarn search, one of the legs being a yarn loosener to be placed against a cop positioned on the transport path; means for rotating the cop to bring the yarn loosener under the reserve yarn winding; and actuation means for closing the scissors after a predetermined search period.

The construction of the yarn loosener as one of two legs of scissors which are open at the onset of the yarn locating operation makes it possible to actively sever yarns which do not tear by themselves during the relative movement of the yarn loosener away from the cop periphery. In this way, yarns are severed which are formed of high-strength or coarse material. In any case this prevents an interlocking of yarn in the yarn loosener from causing blocking in the transport path of the cops.

In accordance with another feature of the invention, there is provided a pivotable frame having a surface facing the periphery of the cop, the yarn loosener being inserted in the pivotable frame and protruding above the surface, at least in a yarn search position.

In accordance with a further feature of the invention, there is provided a pivoting mechanism for the frame, and a coupler connected to the pivoting mechanism, one of the scissor legs being pivotally supported in the frame and connected to the coupler.

In accordance with an added feature of the invention, there is provided a pivot plate of the pivoting mechanism having a stop edge, the coupler having an end facing away from the scissors being articulated in the pivot plate, a rigid shaft on a machine frame, the pivot plate being pivotable about the rigid shaft, the actuation means engaging the rigid shaft, a spring, the frame having a surface facing away from the scissors as seen from the rigid shaft, and the frame being pivotally disposed on the rigid shaft and being taken along by the stop edge of the pivot plate against the force of the spring for engaging the surface of the frame facing away from the scissors.

With the objects of the invention in view, there is also provided, in a winding machine having winding stations and a transport path for leading cops to the winding stations, an apparatus for loosening a reserve yarn winding from peripheries of the cops disposed at the transport path, comprising a yarn loosener to be placed at a cop positioned on the transport path, the yarn loosener having a forward edge for picking up a yarn, and the yarn loosener having a sharp cutting edge with a height being increased at increasing distances from the forward edge for cutting the yarn; and means for rotating the cop to place the forward edge under the reserve yarn winding.

The alternative configuration with a sharp blade on the yarn loosener, in combination with the rotational movement of the cop, leads to the same effect of severing the yarn.

In accordance with another feature of the invention, the sharp cutting edge is a component part of a blade connected to the yarn loosener.

In accordance with a further feature of the invention, the yarn loosener has a contact surface facing the peripheries of the cops, the blade is replaceably inserted in a slit disposed substantially parallel to the contact surface, and the slit has a closed off end facing the forward edge of the yarn loosener.

In accordance with an added feature of the invention, the yarn loosener has a back surface facing away from the peripheries of the cops, and the sharp cutting edge is disposed on the back surface.

In accordance with an additional feature of the invention, there is provided another yarn loosener with a forward edge, and a support in which the yarn looseners are aligned with the forward edges facing one another, for loosening yarn independently of a winding orientation of the yarn on the cop.

In accordance with yet another feature of the invention, there is provided a suction nozzle for aspirating a severed section of the reserve yarn winding.

In accordance with a concomitant feature of the invention, there is provided a roller pair being disposed in the suction nozzle and being movable between an open position and a clamping position, and means for controlling the roller pair to be open while a yarn end is aspirated and driven in the clamping position for drawing-off the yarn end.

When loosening and severing the reserve yarn winding by means of scissors, two basic movements are to be performed, wherein the two movements are superimposed according to a rigid timing pattern. It is thus possible and also structurally viable in the context of the invention, to control both movements by means of a single control mechanism.

Instead of forming the two as an integral unit, it is advantageous when a sharp cutting edge is disposed on the yarn loosener to use a separate blade, which is produced from materials that lengthen its operational life. Since the blade is subject to wear, it is advantageously exchangeable. Furthermore, the position of the blade in the yarn loosener may be adjusted in such a way that an optimal cutting effect is attained in the respective application. As compared to the disposition of the blade on the back of the yarn loosener, its attachment in a slit which is closed at the end facing the forward edge of the yarn loosener offers the advantage of permitting the yarn to slide onto the yarn loosener without having to pass a possibly protruding edge of the blade.

Due to the over-end unwinding of yarn from the cops in the winding machine, it is possible to process cops with different winding orientations. If two yarn looseners with oppositely oriented front edges are provided, the loosening of the yarns is possible independently of the winding orientation on the cop. It is thereby only necessary to reverse the rotational direction of the cop.

Due to the reserve yarn winding, which may reach to the cop foot in a reserve coil, it is possible for a yarn piece to remain on the winding surface of the cop, originating from the reserve coil, after the reserve yarn winding has been severed. That yarn section cannot be grabbed by the following device which searches for the yarn at the upper cop half and which presents the yarn for the subsequent unwinding process, and can be a disturbance during the unwinding of the lower part of the cop. A retrieval at the following station is also not provided, primarily due to the fact that the yarn leading from the severing location to the reserve coil has a different winding orientation than the yarn hanging down from the nose of the cop toward the severing location.

By placing a suction nozzle in the vicinity of the reserve yarn winding loosening implement, that yarn section may be aspirated since at that point it is conventional to use an opposite rotation of the cop as compared to the following preparation station, so as to effectively bring the yarn loosener behind the reserve yarn winding. Since the lower part of the reserve yarn winding is sometimes covered up in the region of the underwinding by overlying windings, it is possible for the suction of the adjacent suction nozzle to be insufficient. However, with the use of draw-off rollers, a draw-off force is applied in such a way that the reserve yarn winding can be pulled off with great reliability. Yarn breakage, especially with the use of strong yarn materials, thereby does not occur.

Other features which are considered as characteristic for the invention are set forth in the appended claims.

Although the invention is illustrated and described herein as embodied in an apparatus for loosening a reserve yarn winding from the periphery of a cop, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
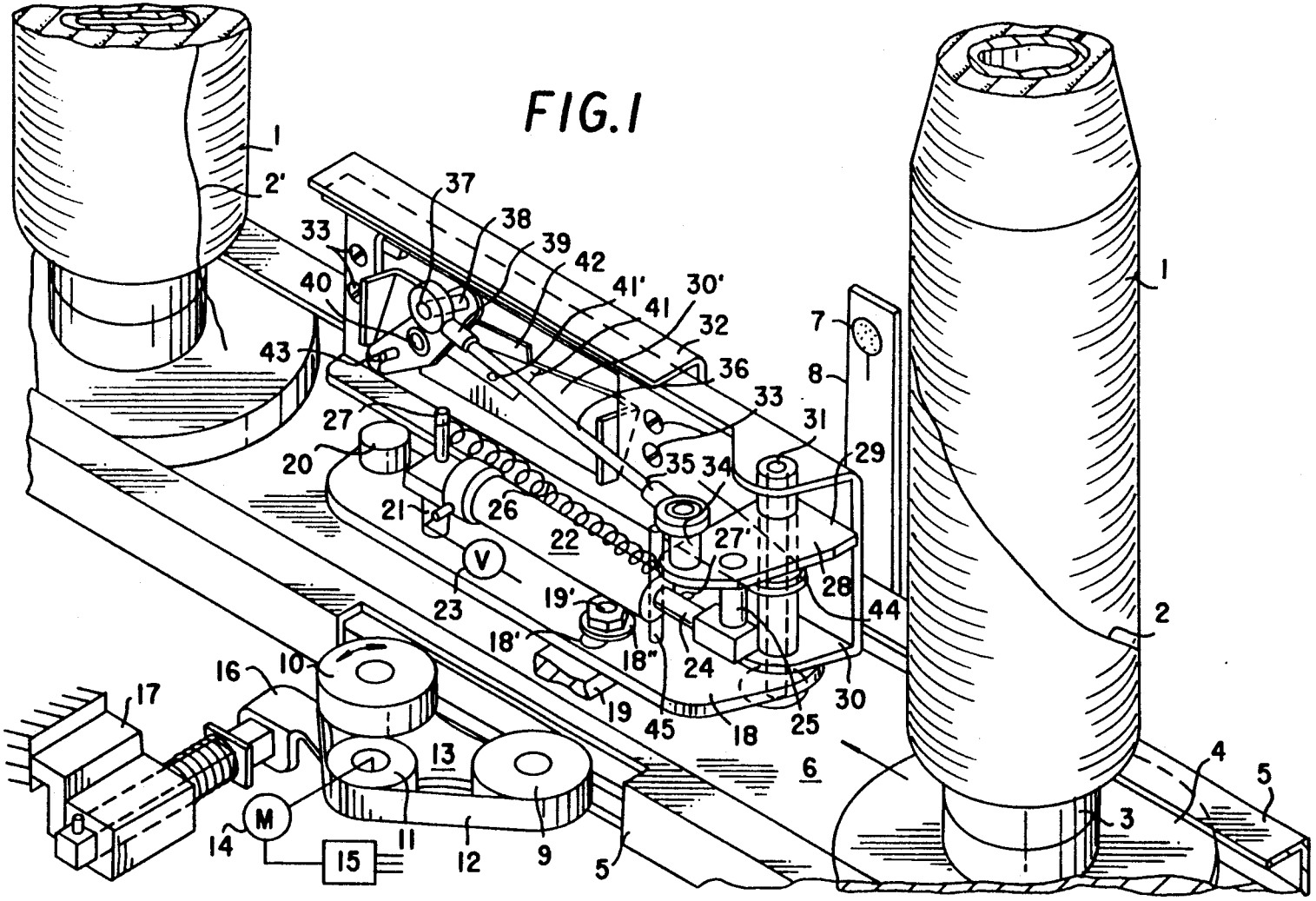
FIG. 1 is a fragmentary, diagrammatic, perspective view of a transport section for cops with an apparatus according to the invention for loosening a reserve yarn winding.

Referring now to the figures of the drawing in detail and first, particularly, to FIG. 1 thereof, there are seen cops 1 that are transported along a guide track 5 on a conveyor belt 6 while standing vertically on caddies 4. The cops 1, which come from a cop supply station or directly from a ring spinning machine, are led to the device according to the invention for loosening a reserve yarn winding 2. That device thereby assumes its basic position as is depicted in FIG. 1, wherein a frame 30 is pivoted away from the cops and thus allows the arriving cops 1 to freely enter that preparation station. The arrival of the cop is recognized by means of a photo-sensor 7, which is mounted on a holder 8 and which forms a light barrier together with a non-illustrated light source disposed across therefrom. In order to position the cop for the yarn locating operation, a non-illustrated stop may be actuated which prevents further transportation of the caddy 4 with the cop 1. The stop is actuated by a control unit 15, which has received an arrival signal for the cop 1 from the photosensor 7. The control unit 15 then actuates a lifting device 17 which moves a carrier 16 with a carrier plate 13 to the guide track 5 and into an opening 5' until a flat belt 12, which is guided about belt rollers 9 to 11, assumes contact with the peripheral surface of the caddy 4.

Figure 5:
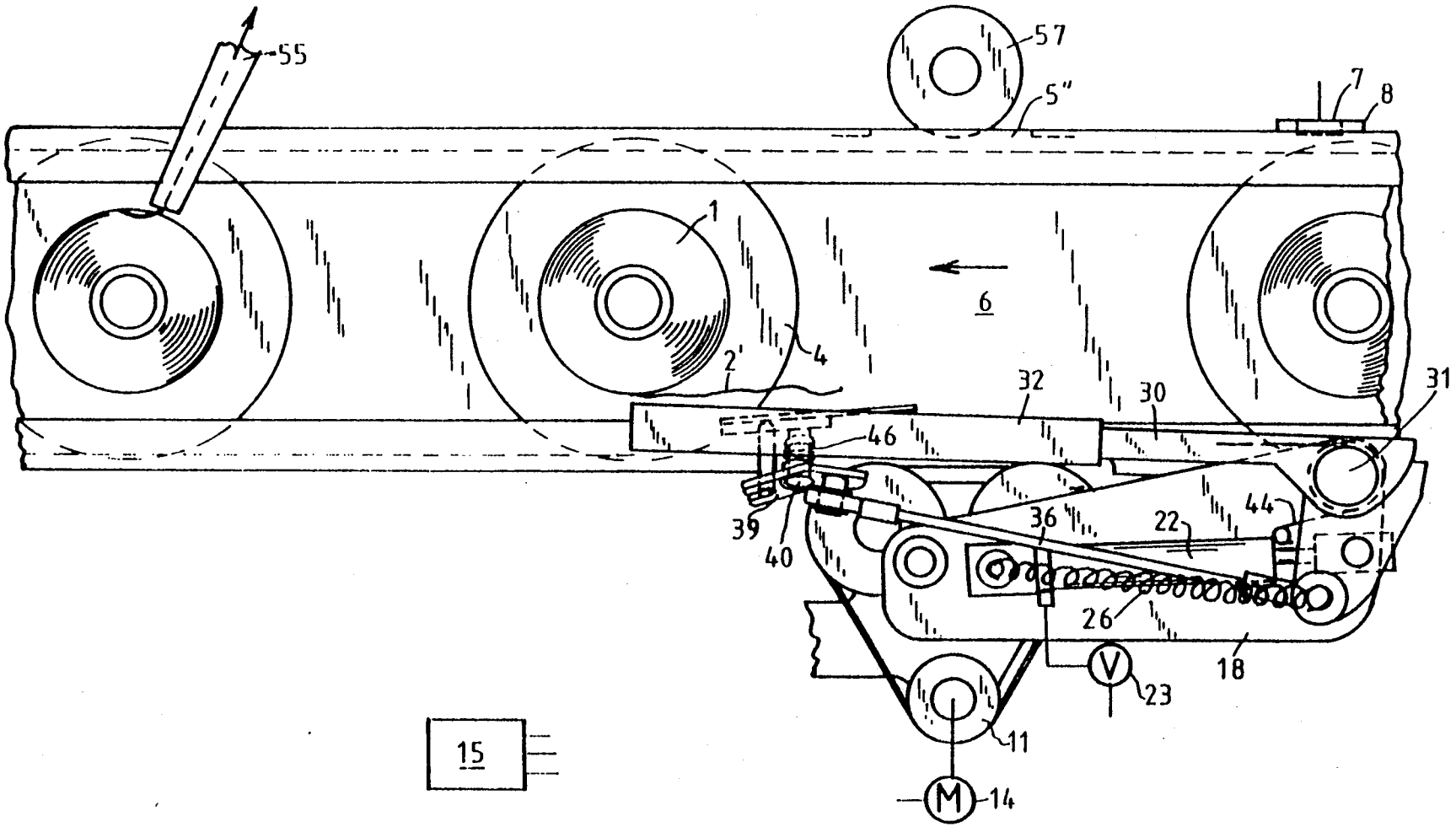
FIG. 5 is a fragmentary, top-plan view of FIG. 4.

As can be seen from FIG. 5, a roller 57 is disposed opposite the opening 5' so that the caddy 4 is pressed against the roller 57. It is thereby also possible to eliminate the stop, because the position of the caddy 4 is determined by the flat belt rollers 9 and 10, which form a triangle together with the roller 57.

The flat belt roller 11 is connected with a drive motor 14, which is also controlled by the control unit 15. The motor 14 is put into operation for producing cop rotation during the yarn locating operation.

Figure 3:
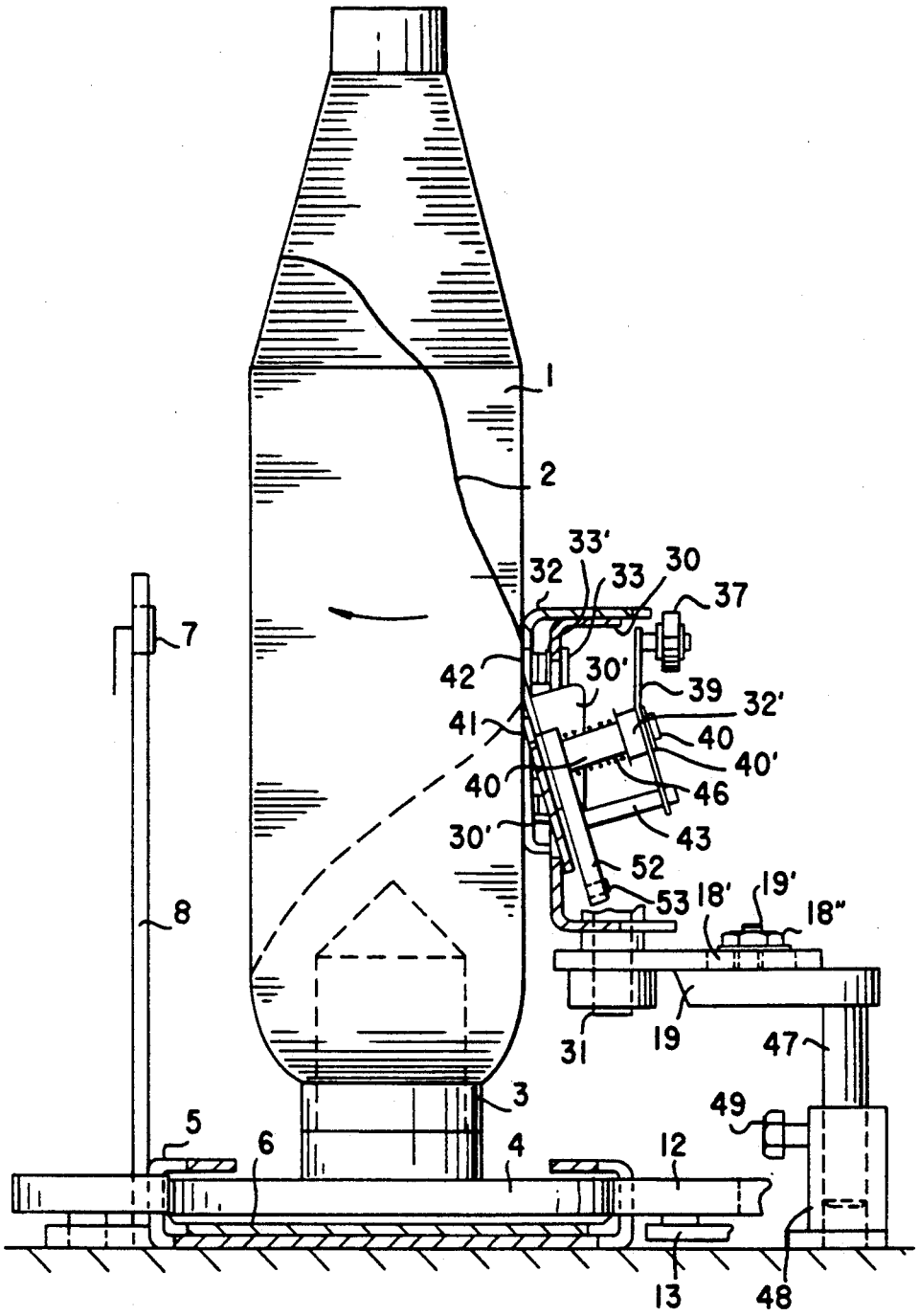
FIG. 3 is a fragmentary, front-elevational view of FIG. 2.

The yarn locating device has a platform 18 which is connected to a basic machine frame through a carrier or support 19 and a stand 47 with a further support 48, as is best seen in FIG. 3. The stand 47 is locked into the holder 48 by means of a locking bolt 49. A threaded stud bolt 19' which is provided on the support or carrier 19, extends through an oblong hole 18' formed in the platform 18. The carrier 19 and the platform 18 are adjustably connected by means of a nut 18'', which is threaded onto the stud bolt 19'.

The platform 18 carries a support 21 for a fluid cylinder 22. The fluid cylinder 22 is supplied with pressurized air, for example, through a valve 23. The valve 23 is also controlled by the control unit 15. A piston 24 which is disposed in the fluid cylinder 22 has a front end that carries a rod 25 which is hinged in a pivot plate 28. Due to this connection, the pivot plate 28 may be pivoted about a shaft 31, which is rigidly disposed on the platform 18.

In order to provide sufficient draw-back force of the piston in the fluid cylinder 22, there is provided a tension spring 26 in addition to an internal spring. The tension spring 26 engages in bolts 27 and 27'. While the bolt 27 is mounted on the support 21 of the fluid cylinder 22, the bolt 27' is mounted on the pivot plate 28. A torsion spring 44 rests on a stop rod 45 mounted on the platform 18, and acts against a frame 30, which is pivotally hinged on the shaft 31, as is the pivot plate 28. Due to the torsion spring 44, the frame 30 is pressed against a stop edge 29 of the pivot plate 28.

In the illustration of FIG. 1, the piston 24 of the fluid cylinder 22 is extended against the force of the torsion spring 44 and the tension spring 26. The stop edge 29 thus pushes against the rear part of the frame 30 which causes the same to pivot into the farthest position in a counter-clockwise direction, as seen from above. In this manner it opens the way for a prepared cop to leave and a new cop 1 to enter, as outlined above.

Figure 4:
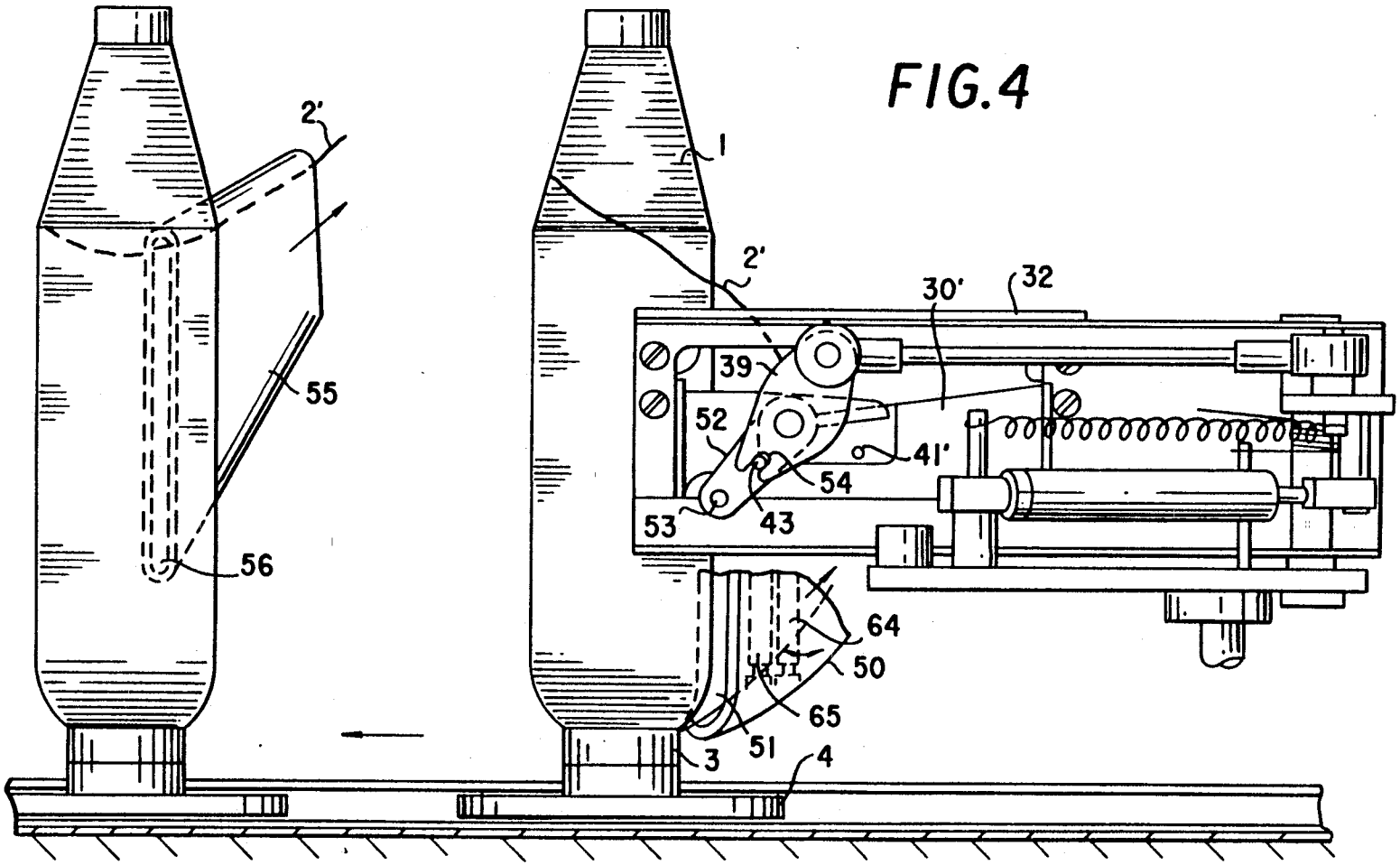
FIG. 4 is a fragmentary, side-elevational view of the apparatus after severing a yarn.

A bolt 34 which is mounted on the pivot plate 28 opposite the stop edge 29 has an upper, rounded end at which a pivot head 35 is disposed. The pivot head 35 is connected to a further pivot head 37 by an actuating rod 36. The further pivot head 37 engages a bolt 38. The bolt 38 is attached to one end of a two-armed lever 39 which is pivotable about a pivot shaft 40. An opposite end of the two-armed lever 39 is provided with a notch 54, in which a follower pin 43 is engaged, as is best seen in FIG. 4. The follower pin 43 is mounted on a follower plate 52, which is connected through a mounting bolt 53 with a yarn loosener 42, that is also formed as a two-armed lever. The two-armed lever 39, the follower plate 52 and the yarn loosener 42 are pivotable about the pivot shaft 40.

The above-described coupler 34 to 38 provides an articulating connection from the pivot plate 28 to the legs of a yarn loosener 42 forming a pair of scissors. A sheet-metal guide plate 32 is attached to the frame 30 with adjustment bolts 33 which act against compression springs 33' seen in FIG. 3. A metal sheet 30' which is incorporated in the frame 30 forms an acute angle with the frame. The pivot shaft 40 is mounted on the metal sheet 30' and it therefore has the same inclination relative to the frame 30. This further determines a pivot plane of the yarn loosener 42. The yarn loosener 42 cooperates with a scissor leg 41, which is rigidly disposed on the metal sheet 30', to form scissors. The scissor leg 41 is secured against rotation and mounted with a bolt 41' and the pivot shaft 40, onto which it is also slipped.

Through the use of the guide plate 32, the adjustment bolts 33 determine how far the yarn loosener 42 protrudes beyond the guide plate 32, which forms a stop surface for the cop, at a given opening angle relative to the stationary scissor leg 41. Accordingly, the penetration depth of the yarn loosener into the cop periphery may be determined in a simple manner with the adjustment bolts 33. However, it is also possible to perform an adjustment in which the opening angle of the scissors which are formed by the yarn loosener 42 and the stationary scissor leg 41 is varied, as will be described below. The latter measure simultaneously affects the direction of effectiveness of the yarn loosener during a yarn search. A further possibility of varying the effectiveness of the yarn loosener 42 is found in its varying shapes. All of these adjustment possibilities are to be applied in dependence on the cop diameter, which provides the radius of curvature at the winding surface, so as to attain an optimal preparation result without causing damage to the other yarn layers.

The cooperation between the guide plate 32 and the yarn loosener 42 is shown especially clearly in the illustration of FIG. 3, wherein the back of the yarn loosener 42 is shown while its tip, which extends as a blade, lightly rests on the winding periphery. This structure helps to prevent a penetration of the yarn loosener into parallel yarn layers.

FIG. 3 also shows the way in which the motion of the coupler 34 to 38 is transferred through the pivot head 37, the two-armed lever 39, the follower pin 43, the follower plate 52 and the attachment bolt 53 onto the yarn loosener 42. The follower plate 52 and the yarn loosener 42 are thereby held in such a way as to be clamped together by means of a compression spring 46, which is supported against a sleeve 32' attached to the two-armed lever 39, so as to provide the necessary scissor-cutting clamping force. The two-armed lever 39 is secured on the pivot shaft 40 by means of a retaining ring 40'.

The mode of operation of the device will be explained in detail below. The valve 23 is open in the basic position, as is illustrated in FIG. 1, which causes the fluid cylinder 22 to be injected with pressurized air and the piston 24 to be extended. A bolt 20 thereby provides a stop for the frame 30 and determines the end position of all of the parts.

While the frame 30 is held in a pivoted position by the stop edge 29, as is described above, the bolt 34, which is disposed on the other end of the pivot plate 28, is also rotated counter-clockwise about the axis 31, in such a way that the scissors formed by the yarn loosener 42 and the stationary scissor leg are closed with the coupler 34 to 38.

Figure 2:
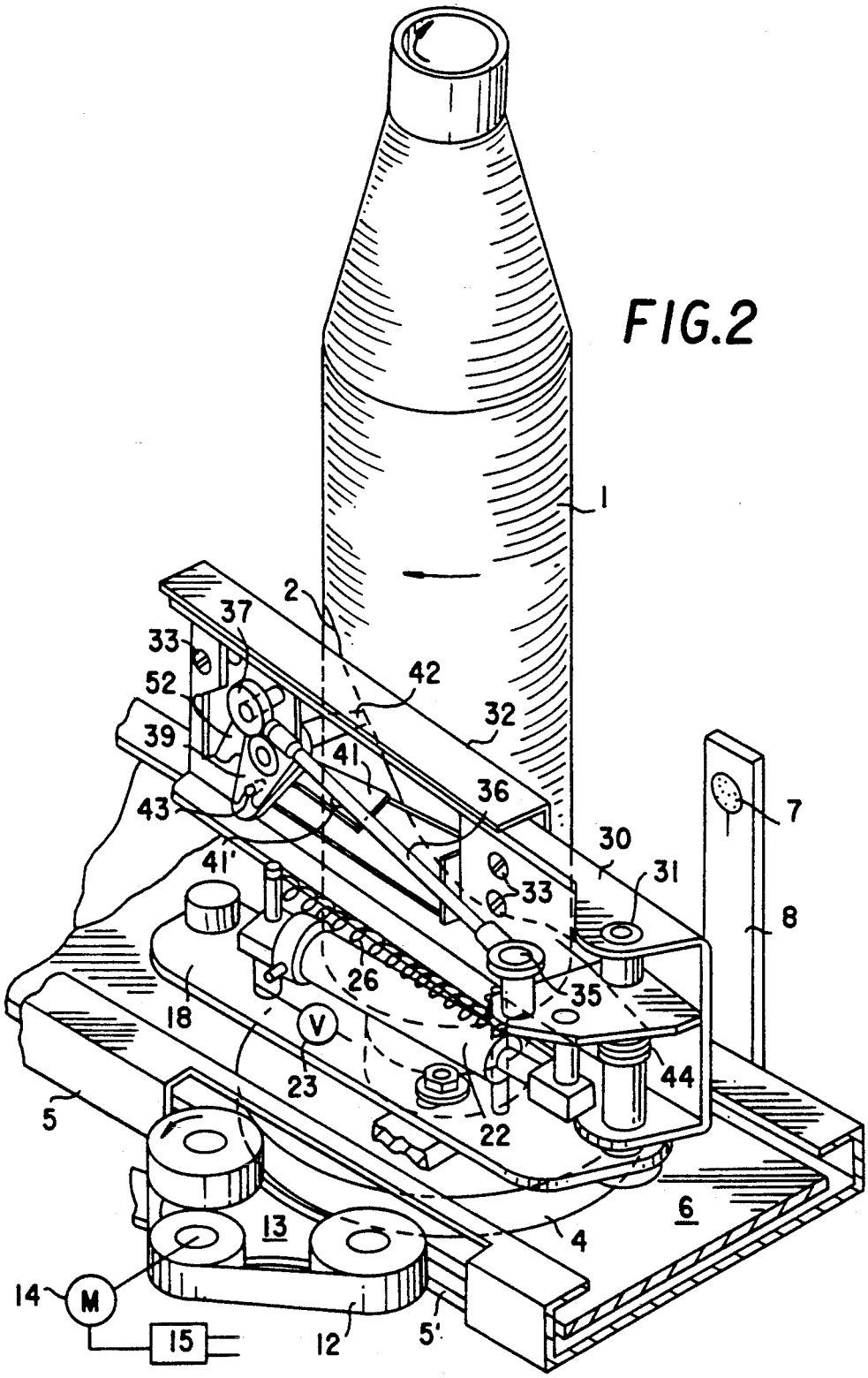
FIG. 2 is a fragmentary, perspective view of the apparatus during a yarn loosening operation.

In the illustration of FIG. 2, the caddy 4 with the cop 1 is positioned in the preparation station. The carrier plate 13 with the belt rollers 9 to 11 which carry the flat belt 12 are pivoted against the periphery of the caddy 4. The fluid cylinder 22 is no longer acted upon by pressure, so that the force of the torsion spring 44 through the frame 30 and the stop edge 29 as well as the tension spring 26 causes the pivot plate 28 to be pivoted clockwise and thus pushes the piston 24 into the fluid cylinder 22. If the frame 30 could freely pivot into the final position of the piston 24 after switching off the pressurized air, then the frame would remain in contact with the stop edge 29 of the pivot plate 28. In that case, no relative motion would be transferred onto the coupler 34 to 38 and to the scissors, which would remain closed. However, since the cop 1 is disposed in the pivoting path of the frame 30, and the guide plate 32 of the frame is stopped on the cop 1, the frame 30 does not further follow the pivoting motion of the pivot plate 28 from that point on. The stop edge 29 thus loses contact with the frame 30. This relative movement between the frame 30 and the pivot plate 28, through the bolt 34, the pivot head 35, the actuating rod 36 and the pivot head 37, causes a counter-clockwise rotation of the two-armed lever 39 about the pivot axis 40. Due to the above-described connection, the yarn loosener 42 is thus pivoted in the same direction, away from the stationary scissor leg 41. Accordingly, the scissors which are formed by the two parts 41 and 42 are opened and the yarn loosener 42 assumes the preadjusted angle of incidence necessary for the yarn search. In this position the motor 14 is put into operation and the flat roller 11 drives the belt 12 disposed about the belt rollers 9 and 10. This puts the caddy 4 with the slipped-on cop 1 in rotation. The rotation of the cop 1 causes the reserve yarn winding 2, which is disposed relatively steeply on the winding periphery, to be caught by the yarn loosener 42 and to slide onto the same. After a predetermined yarn search time, the control unit 15 turns off the motor 14 and thus stops the rotation of the cop 1. It is also envisioned to control the catching of the yarn with a sensor, as is described in German Published, Non-Prosecuted Application DE 39 25 988 A1, corresponding to U.S. Pat. No. 5,083,715, for instance. When the yarn has been located, the control unit turns off the motor 14 immediately.

As can be seen from the foregoing explanation, the path of traverse of the frame is limited by the cop periphery. However, the path of traverse may additionally be determined by adjusting the platform 18, since the position of the platform is adjustable on the support 19 along an oblong hole 18' and the angular position is adjustable in terms of its alignment. Alternatively, the stand 47 may be pivoted about its longitudinal axis after the mounting bolt 48 has been loosened. This changes the distance between the stop edge 29 and the frame 30 when the frame 30, or its guide plate 32, lies on the cop periphery. This relative position between the pivot plate 28 and the frame 30 determines the opening angle of the yarn loosener 42 in the yarn search position.

Simultaneously with turning off the motor 14, or immediately thereafter, the valve 23 is opened and pressurized air acts on the fluid cylinder.

Extending the piston 24 initially causes the pivot plate to pivot until the stop edge 29 reaches the frame 30. This partial pivoting serves to close the scissors 41, 42. The reserve yarn winding 2 is thus securely severed.

When the stop edge 29 of the pivot plate 28 has reached the frame 30 and the scissors have assumed their closure position, the pivot plate 28 takes along the frame 30 on its further pivot path and the frame thus reaches the position illustrated in FIG. 1. Subsequently, the lifting device 17 is actuated and it acts through the carrier 16 to move the support plate 13 away from the guide track 5. The path for the further transportation of the caddy 4 with the cop 1 is thus free.

In order to remove the lower yarn end of the severed reserve yarn winding, which may still lie on the winding periphery of the cop 1 and which could possibly disturb the unwinding of the cop, a suction nozzle 50 may additionally be provided with a suction opening 51, as is illustrated in FIG. 4. It is advantageous to start the operation of the suction nozzle 50 at the instant when the yarn is cut or immediately thereafter. This means that the yarn end which is cut under tension and which first jumps slightly off the cop periphery, may be grasped more easily. The rotational direction of the cop 1 can thereby be maintained. Since the yarn may end in several reserve windings at a foot 3 of the cop 1, where it is covered up by overlying windings, a relatively great suction force may be necessary, which the suction from the suction nozzle 50 may not be capable of providing. A special suction nozzle with pivotable draw-off rollers 64 and 65 is provided for this purpose. These draw-off rollers can clamp against one another after the suction nozzle has been put into operation, i.e. after the yarn end has been aspirated with great likelihood, they can clamp the yarn between one another and they can draw off the yarn with great draw-off force by mutually rolling on each other. When sufficiently strong materials are used, no yarn breakage will be caused by this, which ensures a complete unwinding of the underwinding.

Such a suction nozzle with an associated roller pair is generally advantageous since with it yarn sections which are difficult to loosen or which are relatively long, can be removed from the cop quickly and reliably. When removing the underwinding at the foot of the cop it is even possible to stop the rotational drive for the cop once the yarn has been clamped by the roller pair. In that case, the rest of the yarn is either completely drawn off from the tube foot or torn at that location, which then no longer disturbs the unwinding of the cop.

The roller pair 64, 65 may be pivotable, for instance, for reaching the clamping position. Such a roller pair which is pivotable between an open position and a clamping position and which can reliably perform a yarn transport in its clamping position, is known from German Patent DE-PS 27 11 554, corresponding to U.S. Pat. No. 4,276,742, for example. For that reason it is not necessary to describe and illustrate such a device in more detail herein.

In the alternative it is possible to form the yarn loosener as a stationary scissor leg, while the scissor leg described in the exemplary embodiment as being stationary is pivotable by a coupler.

It is further possible to provide separate drives for the scissors and the pivot frame carrying the scissors which are controlled with a control unit in accordance with the necessary timing sequence. However, the described embodiment, which can make do with just one drive, has the relative advantage.

It is furthermore envisioned to place further yarn looseners above the described reserve yarn winding loosener for grasping the severed upper yarn end.

As can also be seen from FIG. 4, a further processing station is provided at the guide track 5, although only a suction nozzle 55 with a suction opening 56 is indicated. That suction nozzle aspirates an upper end 2' of the reserve yarn winding 2. This yarn end can then be wound into a overwinding or can be laid onto the tube itself. It is essential that the yarn end may be grasped in the winding station by the respective yarn pick-up members.

Figure 6:
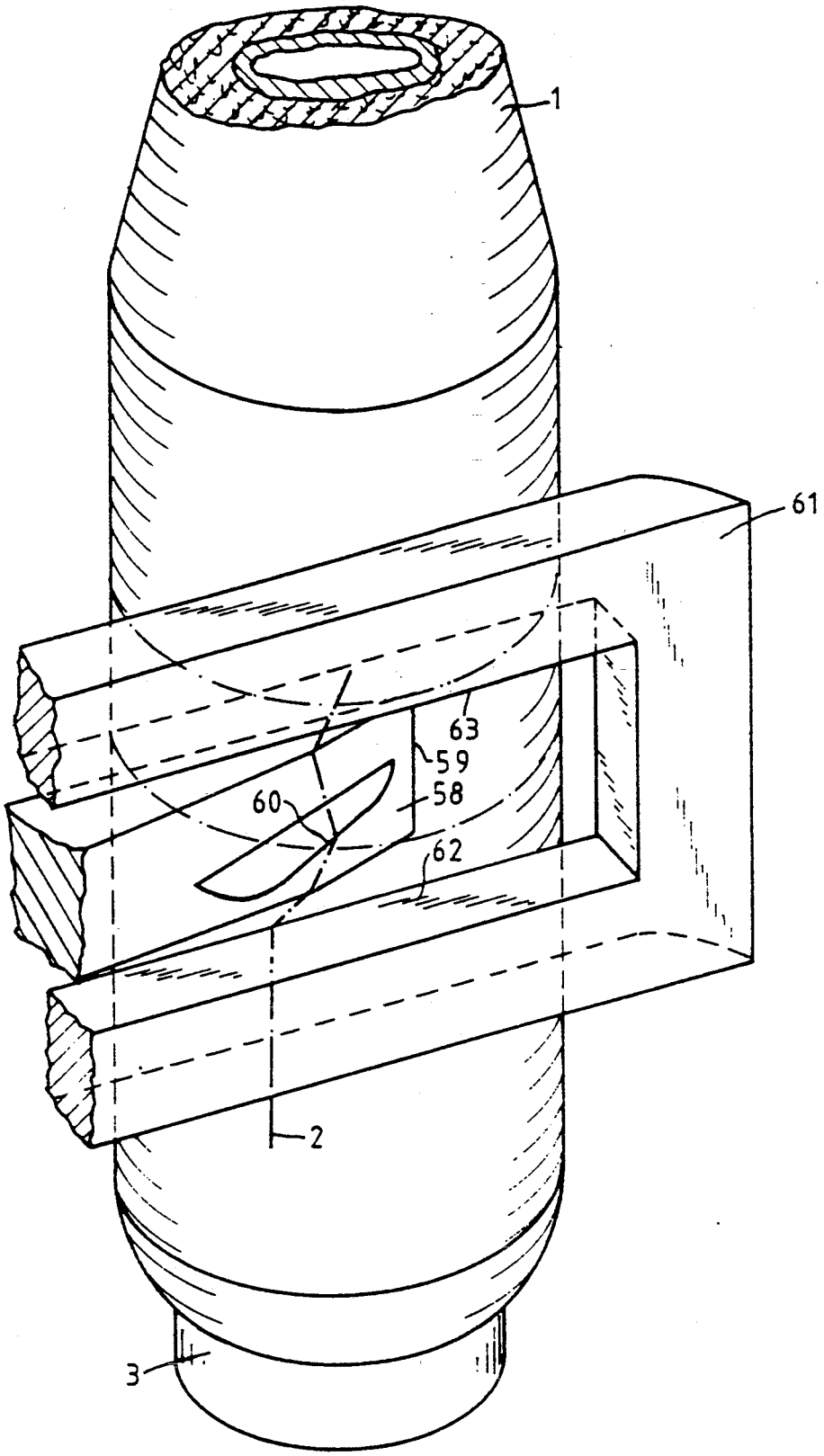
FIG. 6 is a fragmentary, perspective view of another embodiment of the yarn loosening device according to the invention.

The further embodiment of the invention illustrated in FIG. 6 shows only essential parts of the device for loosening the reserve yarn winding. A yarn loosener 58 has a wedge-shaped forward edge 59 which reaches under the reserve yarn winding 2 during the rotation of the cop, and a sharp cutting edge 60 perpendicularly disposed on its back. The reserve yarn winding 2 slides onto the cutting edge 60. The yarn is severed due to the relative movement between the yarn and the blade. The blade has a rise towards the rear, which additionally tightens the reserve yarn 2 and increases the pressure on the cutting edge. Accordingly, even this simple solution provides a high degree of severing reliability for the reserve yarn winding 2.

Additionally, a frame 61, which has the same supporting function as the guide plate 32, has yarn guide edges 62 and 63 which tension the reserve yarn winding 2 over the sharp cutting edge 60 in the form of a loop. This improves the cutting effect even more.

The cutting edge 60 may be a sharpened edge of a part which is formed on the back of the yarn loosener 58. However, it is also possible to mount a blade in the yarn loosener 58, for instance by soldering.

Such a blade may also be attached flat on the back of the yarn loosener 58, so that the cutting edge rises on the upper surface of the yarn loosener 58 with increasing distance from the wedge-shaped forward edge 59 of the yarn loosener 58. The yarn is reliably severed due to its relative movement with respect to the cutting edge.

However, in this non-illustrated embodiment it is disadvantageous for a forward edge of the blade to form a step on the back of the yarn loosener 58, in which the yarn 2 sliding onto the yarn loosener 58 may be caught.

Figure 7:
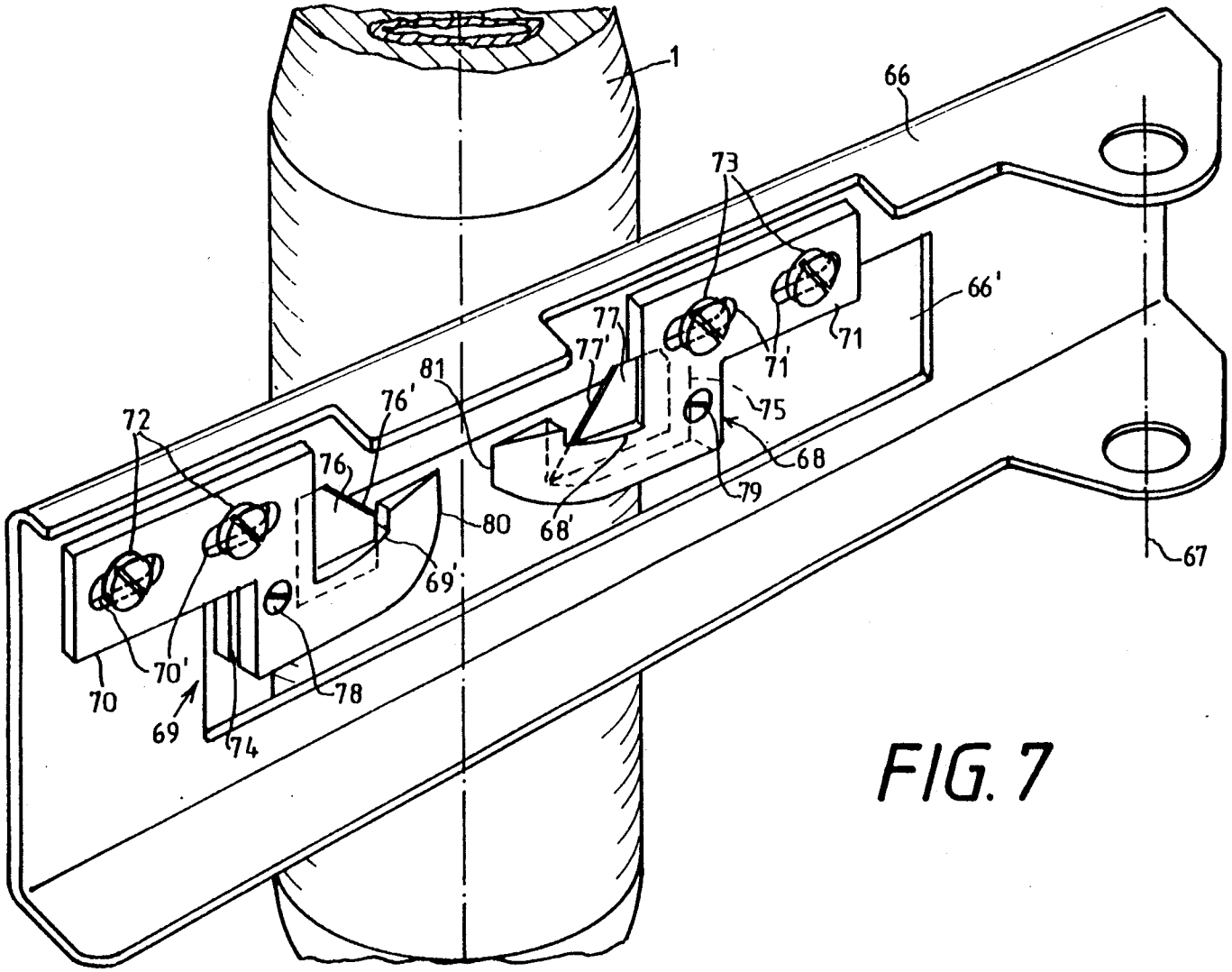
FIG. 7 is a fragmentary, perspective view of a further embodiment of the yarn loosening device according to the invention.

This problem is faced with the embodiment of a yarn loosener depicted in FIG. 7. Two yarn looseners 68 and 69 which protrude through a window 66' are mounted on a support 66 that is formed in a manner similar to the guide plate 32 and which is pivotable about a pivot axis 67.

The pivoting mechanism for the support 66, the rotational drive for the cop 1 and the transport and stopping device for the non-illustrated cop-carrying caddies can be provided with the structure described in the context of the first embodiment.

The yarn looseners 68 and 69 have support plates 70 and 71 which are provided with oblong holes 70' and 71', respectively. Bolts 72 and 73 extend through the oblong holes 70' and 71' in order to mount the yarn looseners 68 and 69 on the support 66. The oblong holes 70' and 71' allow adjustment of the yarn looseners 68 and 69, especially in dependence on the diameter of the cops to be processed.

The yarn looseners 68 and 69 are provided with slits 74 and 75 which extend essentially parallel to a contact surface of the yarn looseners 68 and 69 facing the cop periphery. The slits 74 and 75 are closed off at ends thereof facing respective forward edges 80 and 81 of the yarn looseners 68 and 69. Forward edges of blades 76 and 77 which are inserted in the respective slits 74 and 75, face toward the forward edges 80 and 81 and are thus covered. Accordingly, yarns sliding onto the yarn looseners 68 and 69 cannot catch in the blades 76 and 77.

The blades 76 and 77 are exposed in the vicinity of recesses 68' and 69' in the yarn looseners 68 and 69, i.e. outside of the slits 74 and 75. They are provided with cutting edges 76' and 77' that are disposed obliquely in the yarn looseners 68 and 69. This ensures that a yarn which has been engaged by the respective forward edge 80 or 81 slides onto the respective cutting edge 76' or 77', so as to cause an increase in yarn tension due to the increasing height of the cutting edge. This increases the pressure on the cutting edge and thus the severing force.

The slits 74 and 75 are restricted by clamping screws 78 and 79 after the blades 76 and 77 are inserted, in such a way that a secure clamping for the two blades results. After they are worn, the blades can simply be replaced after the clamping screws 78 and 79 have been loosened.

Depending on the winding orientation of the cop 1 passing through the preparation apparatus, either the yarn loosener 68 or the yarn loosener 69 comes into operation. The rotation of the cop is correspondingly adjusted with the drive shown in FIGS. 1 and 2. The apparatus according to the invention can thus be employed for both winding orientations of the cops. Analogously to the illustration in FIGS. 1 to 3, an adjustment of the entire device is possible, from which the basic position of the support 66 results.

We claim:

1. In a winding machine having winding stations and a transport path for leading cops to the winding stations, an apparatus for loosening a reserve yarn winding from peripheries of the cops disposed at the transport path, comprising:

scissors having two legs being open at an onset of a yarn search, one of said legs being a yarn loosener to be placed against a cop positioned on the transport path;

means for rotating the cop to bring said yarn loosener under the reserve yarn winding; and actuation means for closing said scissors after a predetermined search period.

2. The apparatus according to claim 1, including a pivotable frame having a surface facing the periphery of the cop, said yarn loosener being inserted in said pivotable frame and protruding above said surface, at least in a yarn search position.

3. The apparatus according to claim 2, including a pivoting mechanism for said frame, and a coupler connected to said pivoting mechanism, one of said scissor legs being pivotally supported in said frame and connected to said coupler.

4. The apparatus according to claim 3, including a pivot plate of said pivoting mechanism having a stop edge, said coupler having an end facing away from said scissors being articulated in said pivot plate, a rigid shaft, said pivot plate being pivotable about said rigid shaft, said actuation means engaging said rigid shaft, a spring, said frame having a surface facing away from said scissors as seen from said rigid shaft, and said frame being pivotally disposed on said rigid shaft and being taken along by said stop edge of said pivot plate against the force of said spring for engaging said surface of said frame facing away from said scissors.

5. The apparatus according to claim 1, including a suction nozzle for aspirating a severed section of the reserve yarn winding.

6. The apparatus according to claim 5, including a roller pair being disposed in said suction nozzle and being movable between an open position and a clamping position, and means for controlling said roller pair to be open while a yarn end is aspirated and driven in said clamping position for drawing-off the yarn end.

7. In a winding machine having winding stations and a transport path for leading cops to the winding stations, an apparatus for loosening a reserve yarn winding from peripheries of the cops disposed at the transport path, comprising:

a yarn loosener to be placed at a cop positioned on the transport path, said yarn loosener having a forward edge for picking up a yarn, and said yarn loosener having a sharp cutting edge with a height being increased at increasing distances from said forward edge for cutting the yarn; and means for rotating the cop to place said forward edge under the reserve yarn winding.

8. The apparatus according to claim 7, wherein said sharp cutting edge is a component part of a blade connected to said yarn loosener.

9. The apparatus according to claim 8, wherein said yarn loosener has a contact surface facing the peripheries of the cops, said blade is replaceably inserted in a slit disposed substantially parallel to said contact surface, and said slit has a closed off end facing said forward edge of said yarn loosener.

10. The apparatus according to claim 9, wherein said yarn loosener has a back surface facing away from the peripheries of the cops, and said sharp cutting edge is disposed on said back surface.

11. The apparatus according to claim 7, including another yarn loosener with a forward edge, and a support in which said yarn looseners are aligned with said forward edges facing one another, for loosening yarn independently of a winding orientation of the yarn on the cop.

12. The apparatus according to claim 7, including a suction nozzle for aspirating a severed section of the reserve yarn winding.

13. The apparatus according to claim 12, including a roller pair being disposed in said suction nozzle and being movable between an open position and a clamping position, and means for controlling said roller pair to be open while a yarn end is aspirated and driven in said clamping position for drawing-off the yarn end.

* * * * *